US007941948B2

(12) United States Patent
Bardolph et al.

(10) Patent No.: US 7,941,948 B2
(45) Date of Patent: May 17, 2011

(54) PRESSURE SEALED POINT OF SALE CARD PACKAGE

(75) Inventors: Doug Bardolph, Villa Park, IL (US); Joel Munk, Lisle, IL (US)

(73) Assignee: Metavante Corporation, Jacksonville, FL (US)

( * ) Notice: Subject to any disclaimer, the term of this patent is extended or adjusted under 35 U.S.C. 154(b) by 393 days.

(21) Appl. No.: 11/503,229

(22) Filed: Aug. 11, 2006

(65) Prior Publication Data

US 2008/0034624 A1 Feb. 14, 2008

(51) Int. Cl.
*G09F 1/00* (2006.01)

(52) U.S. Cl. ..... 40/124.09; 229/92.1

(58) Field of Classification Search ..... 40/126.09; 229/92.1, 92.3
See application file for complete search history.

(56) References Cited

U.S. PATENT DOCUMENTS

| | | | | |
|---|---|---|---|---|
| 4,887,763 | A | 12/1989 | Sano | |
| 5,174,491 | A * | 12/1992 | Taylor et al. | 229/92.1 |
| 5,314,110 | A | 5/1994 | Lombardo | |
| 5,399,021 | A | 3/1995 | Litt | |
| 5,427,832 | A | 6/1995 | Longtin | |
| 5,629,977 | A | 5/1997 | Fonseca | |
| 5,667,247 | A | 9/1997 | Ramsburg et al. | |
| 5,692,671 | A | 12/1997 | Mussier et al. | |
| 5,697,496 | A | 12/1997 | Bauer | |
| 5,760,381 | A | 6/1998 | Stich et al. | |
| 5,918,909 | A | 7/1999 | Fiala et al. | |
| 6,131,802 | A | 10/2000 | Lombardo | |
| 6,158,777 | A | 12/2000 | Twardosz | |
| 6,273,470 | B1 | 8/2001 | Bullock | |
| 6,500,293 | B1 * | 12/2002 | Dexter | 156/264 |
| 2001/0048021 | A1 * | 12/2001 | Hill et al. | 229/92.1 |
| 2002/0100797 | A1 | 8/2002 | Hollingsworth et al. | |
| 2003/0141371 | A1 | 7/2003 | Davila et al. | |
| 2003/0236715 | A1 | 12/2003 | Leo | |
| 2004/0046035 | A1 | 3/2004 | Davila et al. | |
| 2004/0094948 | A1 | 5/2004 | Laurash et al. | |
| 2004/0187368 | A1 | 9/2004 | Foster | |
| 2005/0204600 | A1 | 9/2005 | Lauer et al. | |
| 2005/0275870 | A1 | 12/2005 | Elarde et al. | |
| 2006/0032764 | A1 | 2/2006 | Swenson | |

* cited by examiner

*Primary Examiner* — Joanne Silbermann
(74) *Attorney, Agent, or Firm* — Finnegan, Henderson, Farabow, Garrett & Dunner, L.L.P.

(57) ABSTRACT

A point of sale card package, and method for manufacturing same, include an intermediate in the form of a sheet of paper material which is sequentially V-folded twice about a first and a second fold line, extending orthogonally to one another, to form four stacked panels defined by and connected at the fold lines, with a credit-card-like card disposed between two adjacent ones of the stacked panels, and the with separate portions of the peripheries of the stacked panels being adhesively joined together by a pressure sensitive adhesive.

20 Claims, 8 Drawing Sheets

PRESSURE SEALED POINT OF SALE CARD PACKAGE

FIELD OF THE INVENTION

This invention is related to the packaging and sale of credit-card-like cards, such as pre-paid phone cards, gift cards, etc., and more particularly to a point of sale card package for such cards.

BACKGROUND OF THE INVENTION

There is an ongoing need to provide an efficient and effective point of sale card package, to support retail sales of credit-card-like cards, made of plastic, paper or other appropriate materials. Previous attempts at providing such point of sale packages have not been entirely satisfactory, however. Further improvement is desirable.

In general, prior point of sale card packages have entailed cumbersome construction, involving the use of highly specialized equipment, and non-standard-sized sheets of cardboard or paper as an intermediate, for forming the card package. It is desirable that an improved card package, and methods for constructing such a card package, be capable of utilizing standard sheet sizes, such as 8½" by 11" letter paper, which can be processed on equipment which is commonly available to those in the business of providing such cards.

It is also desirable, that an improved card package provide a large area for receiving printed text and/or graphics, relating to the sale and use of the card contained within the package. For example, it is desirable that the card package include a sufficiently large surface area to display the terms and conditions of issuance and use of the card attached to the package, without the need for resorting to extremely fine print, or the inclusion of additional pages of printed instruction being enclosed within the card package. For efficiency and effectiveness of manufacturer, at reasonable cost and with minimal environmental impact, it is desirable that the card package itself, includes sufficient surface area to accommodate whatever printed text and graphics are required for sale and use of the card. Prior point of sale card packages are typically too small to meet these requirements.

It is further desirable that an improved point of sale card package, and methods for constructing such a package, provide considerable flexibility with regard to the manner of application and content of the text and graphics printed onto the package. For example, it is desirable that an improved package, and method of constructing such a package, allow for both pre-printing of the package, prior to attachment of the card to the package, and also for dynamic printing of text and graphics onto the package substantially contemporaneously with attachment of the card to the card package. It is also desirable that the dynamically printed text or graphics can be uniquely linked to the information printed on or encoded into the card.

For security reasons, it is desirable that an improved card package be capable of completely enclosing and sealing the card within the package, in a manner which precludes damage to or tampering with the card, while it is in the package, but yet is still readily openable by the purchaser and/or a legitimate user of the card.

BRIEF SUMMARY OF THE INVENTION

The invention provides an improved point of sale card package, and method for constructing such an improved card package, through use of a point of sale card package including an intermediate in the form of a sheet of paper material having first and second faces thereof, which is V-folded a first time about a first fold line with the first face of the sheet disposed inside of the V-fold, and the resultant V-folded sheet then being V-folded a second time about a second folding line extending orthogonally to the first fold line, to form four stacked panels defined by and connected at the fold lines in such a manner that each panel has at least one first or second surface thereof juxtaposed with a first or second surface of an adjacent panel of the stacked panels of the intermediate sheet. The card is disposed between the juxtaposed surfaces of two adjacent ones of the stacked panels and is attached to one of the two juxtaposed surfaces of the adjacent stacked panels.

The first face of the sheet of the intermediate, according to the invention, may be adapted to form the majority of an interior of the card package, with the second face of the sheet being adapted to form part of the interior of the card package and part of the exterior of the card package, when the card package is constructed. The sheet may include an outer periphery thereof, centered, and extending symmetrically, about the intersection of the first and second orthogonally intersecting fold lines of the sheet, in such a manner that each of the first, second, third, and fourth panels of the sheet include a respective part of the first and second faces of the sheet. The first and second panels are joined to one another along the second fold line, the third and fourth panels are joined to one another along the second fold line, the first and third panels are joined to one another along the first fold line, and the second and fourth panels are joined to one another along the first fold line.

In an intermediate, according to the invention, a line of weakness, such as a row of perforations, may be disposed about the periphery of the sheet, and extend substantially completely along the periphery, to thereby define a margin extending about the periphery between the line of weakness and the periphery. A first elongated pattern of adhesive may be disposed in the margin on the first face of the sheet and extend substantially entirely around the line of weakness. A second elongated pattern of adhesive may be disposed in the margin on the second face of the sheet and extend substantially entirely along a portion of the line of weakness in the first and second panels only.

The adhesive patterns in the margins is utilized for bonding juxtaposed surfaces of the stacked panels to one another. In some forms of the invention, the adhesive in one or both of the first and second elongated patterns of adhesive is a pressure activated cohesive. To preclude having the adhesive in the margins of adjacent intermediate sheets stick to one another, while the intermediate sheets are stacked prior to V-folding, and thereby causing feed problems or jamming of the type experienced during the manufacturer of prior card packages or other types of business forms, the substantially U-shaped second elongated pattern of adhesive on the second face of the intermediate sheet, according to the invention, may be disposed farther outward from the line of weakness than the first elongated pattern of adhesive on the first side of the intermediate sheet according to the invention. In this manner, the second elongated pattern of adhesive will not be disposed in direct contact with the first pattern of elongated adhesive while the intermediate sheets are stacked upon one another. In addition, adjacent sheets of intermediate may be fed into processing equipment in such a direction that the first elongated pattern of adhesive is never required to pass directly across the second elongated pattern of adhesive disposed farther outward from the line of weakness than the first elongated pattern of adhesive.

In some forms of the invention, a second card or other type of insert may be disposed between juxtaposed surfaces of two adjacent ones of the stacked panels.

In some forms of the invention, each of the panels of the sheet of the intermediate further defines a hanging feature extending therethrough, with the hanging features of the panels being symmetrically disposed about the intersection of the first and second fold lines, and the intersection of the first and second fold lines, in such a manner that the hanging features of the panels will be substantially aligned with one another when the sheet is V-folded a first time about the first fold line, and then subsequently V-folded a second time about the second fold line.

The invention may be practiced in a variety of forms, including, but not limited to: an intermediate for a point of sale card package, according to the invention; a combination of a credit-card-like card attached to a point of sale card package, according to the invention; a method for manufacturing a point of sale card package, according to the invention; and/or a method for manufacturing the combination of a credit-card-like card, or other card or insert materials, together with a point of sale card package, according to the invention.

A method for manufacturing a point of sale card package, according to the invention, may include manufacturing an intermediate, in the form of a sheet of paper material, having a first face adapted to form a majority of an interior of the card package, and a second face adapted to form part of the interior of the card package and part of the exterior of the card package, when the card package is constructed. The sheet may have an outer periphery thereof centered and extending symmetrically about an intersection of first and second orthogonally intersecting fold lines of the sheet, to define first, second, third, and fourth panels of the sheet, with each panel including a respective part of the first and second faces of the sheet. The first and second panels are joined to one another along the second fold line, the third and fourth panels are joined to one another along the second fold line, the first and third panels are joined to one another along the first fold line, and the second and fourth panels are joined to one another along the first fold line.

A method, according to the invention, may further include forming a line of weakness disposed adjacent the periphery of the sheet and extending substantially completely along the periphery, to thereby define a margin extending about the periphery between the line of weakness and the periphery. A first elongated pattern of adhesive may be applied in the margin on the first face of the sheet and extend substantially entirely around the line of weakness. A second elongated pattern of adhesive may be disposed in the margin on the second face of the sheet and extend substantially entirely along a portion of the line of weakness in the first and second panels only.

A method, according to the invention, may further include pre-printing text and/or graphics onto a portion of at least one of the first and second faces of the intermediate sheet. A method, according to the invention, may further include attaching the card to the first surface of one of the panels. A method may further include printing text and/or graphics onto a portion of at least one of the first and second faces of the sheet substantially contemporaneously with attaching the card to the first surface of one of the panels. The text and/or graphics printed onto the sheet may be uniquely linked to information on, or encoded into, the card.

A method, according to the invention, may further include forming a hanging feature in each of the panels, extending therethrough, with the hanging feature of the panels being symmetrically disposed about the intersection of the first and second fold lines in such a manner that the hanging feature of the panels will be substantially aligned with one another when the sheet is V-folded a first time about the first fold line, and then V-folded a second time about the second fold line.

A method, according to the invention, may include V-folding the sheet a first time about the first fold line, with the first face of the sheet disposed inside of the V-fold, and then V-folding the resultant V-folded sheet a second time about the second fold line, to place the panels in a stacked orientation with respect to one another, in such a manner that each panel has at least one first or second surface thereof juxtaposed with a first or second face of an adjacent panel of the stacked panels. In some forms of the invention, wherein the adhesive in one or both of the first and second elongated patterns of adhesive is a pressure activated cohesive, a method, according to the invention, may further include applying pressure to the margins of the stacked panels for sealing the package.

Other aspects, objects and advantages of the invention will be apparent from the following detailed description and accompanying drawings of exemplary embodiments of the invention.

BRIEF DESCRIPTION OF THE DRAWINGS

The accompanying drawings, incorporated in and forming a part of the specification, illustrate several aspects of the present invention, and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
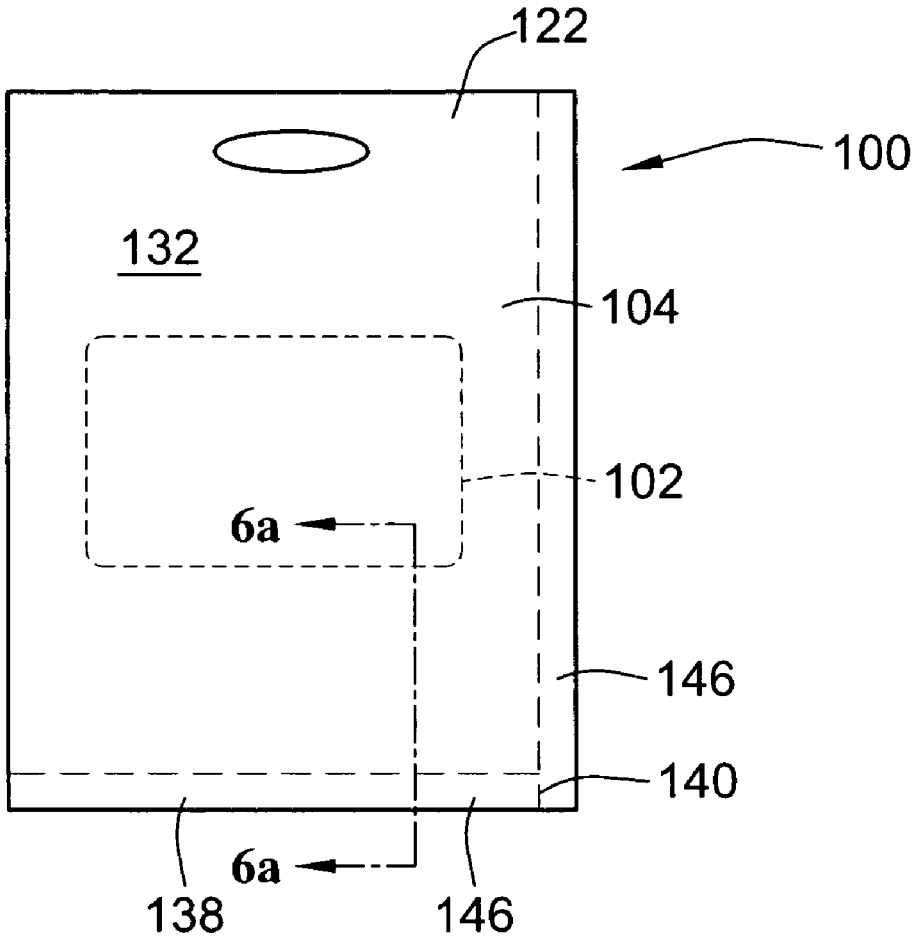
FIG. 1 is a plan view of a first exemplary embodiment of a point of sale card package, with a card attached thereto, in accordance with the invention.
Figure 2:
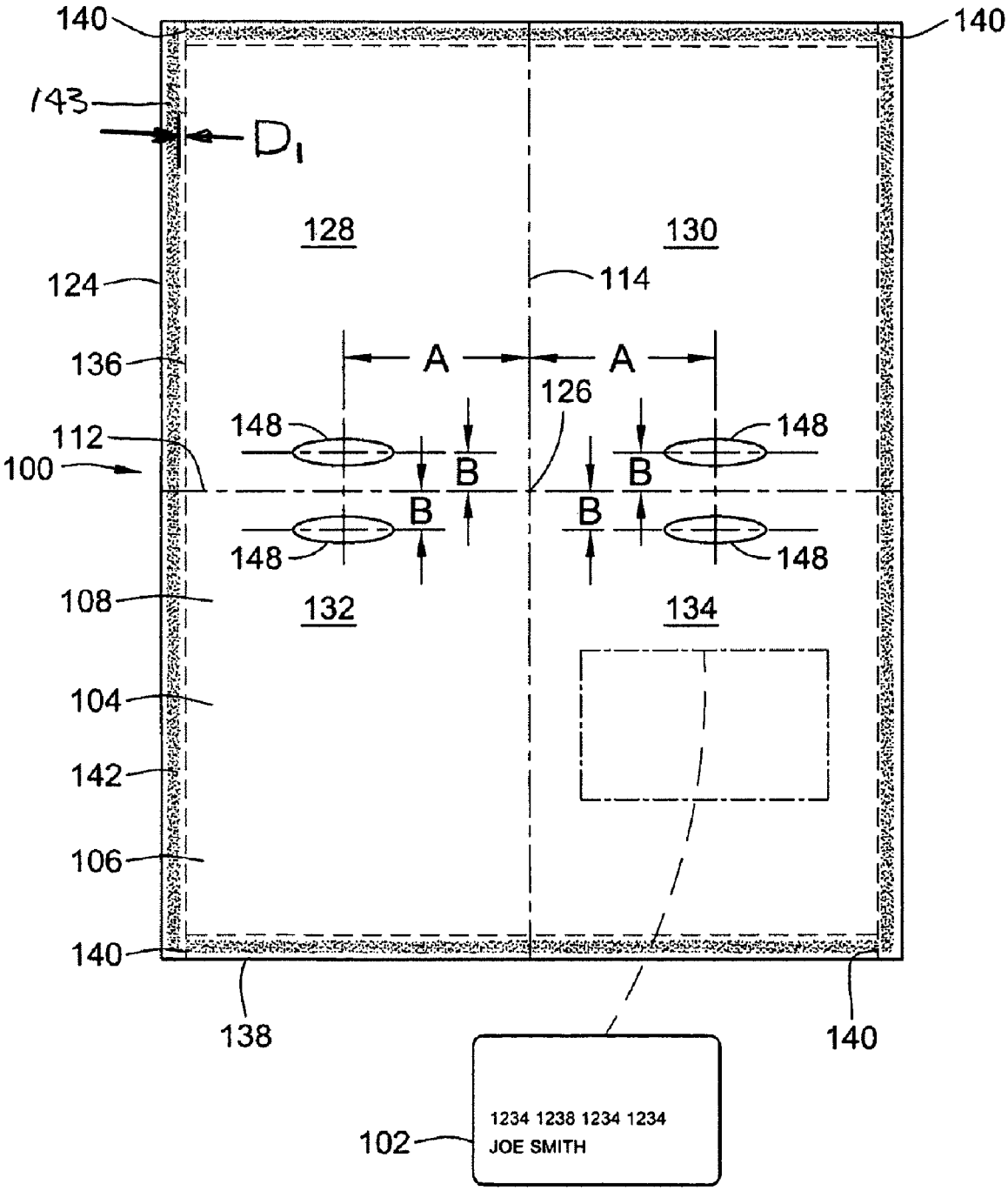
FIGS. 2 and 3, respectively, are plan views of first and second opposite faces of an intermediate sheet of the exemplary embodiment of the card package shown in FIG. 1.
Figure 3:
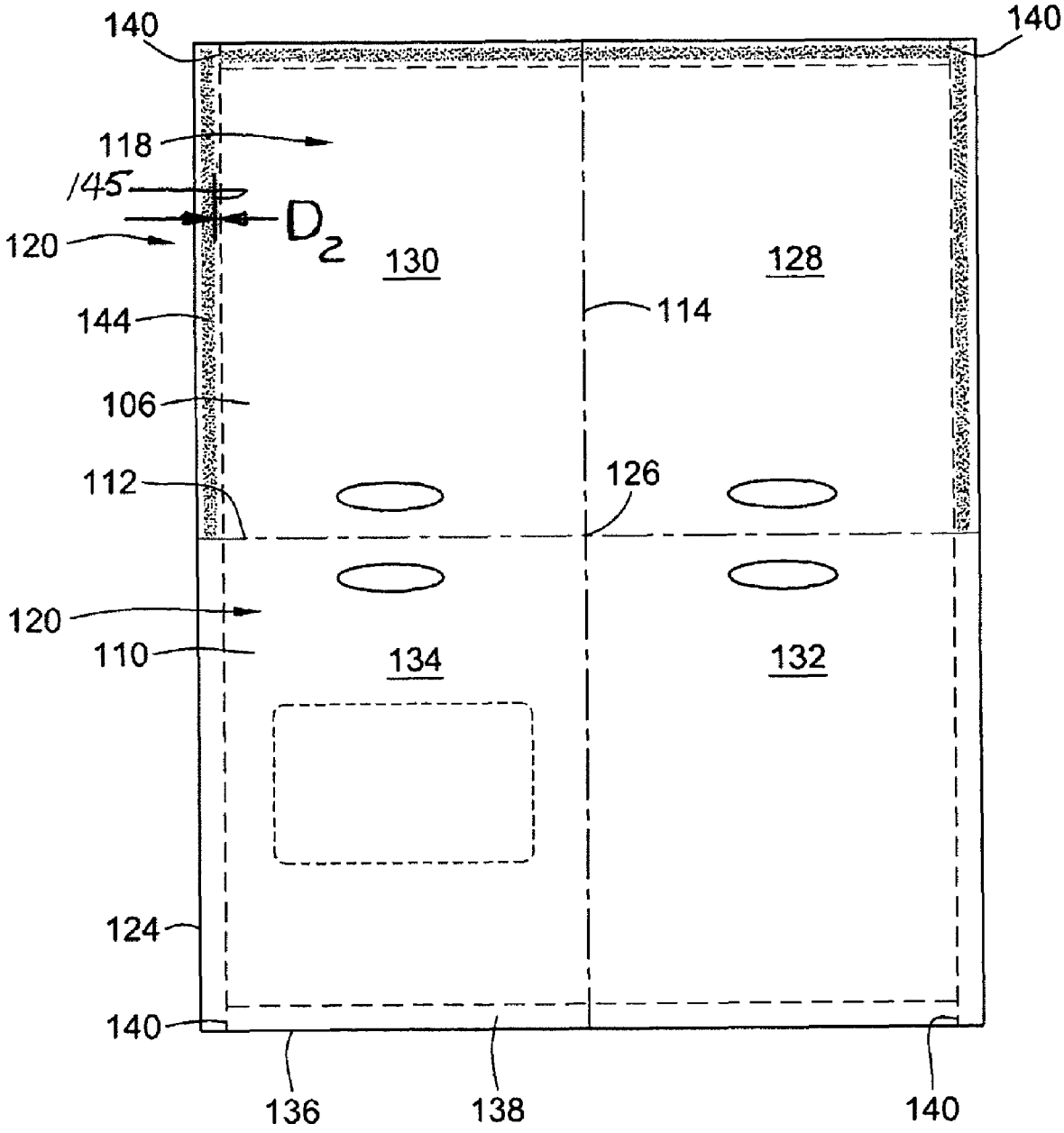

FIGS. 1-5 illustrate a first exemplary embodiment of the invention, in the form of a point of sale card package 100, including a credit-card-like card 102 sealed within a point of sale package 104 formed from a twice-folded intermediate 106. As shown sequentially in FIGS. 4-6, the intermediate 106, of the exemplary embodiment 100, is a rectangular sheet of paper material, illustrated in standard letter size of 8½" wide by 11" long. The intermediate sheet 106 defines a first face 108 thereof, as shown in FIG. 2, and a second face 110 thereof, as shown in FIG. 3. It will be understood, by those having skill in the art, that FIG. 3 illustrates the obverse side of the sheet 106 illustrated in FIG. 2, rotated about a vertical axis, as illustrated in FIGS. 2 and 3.

Figure 4:
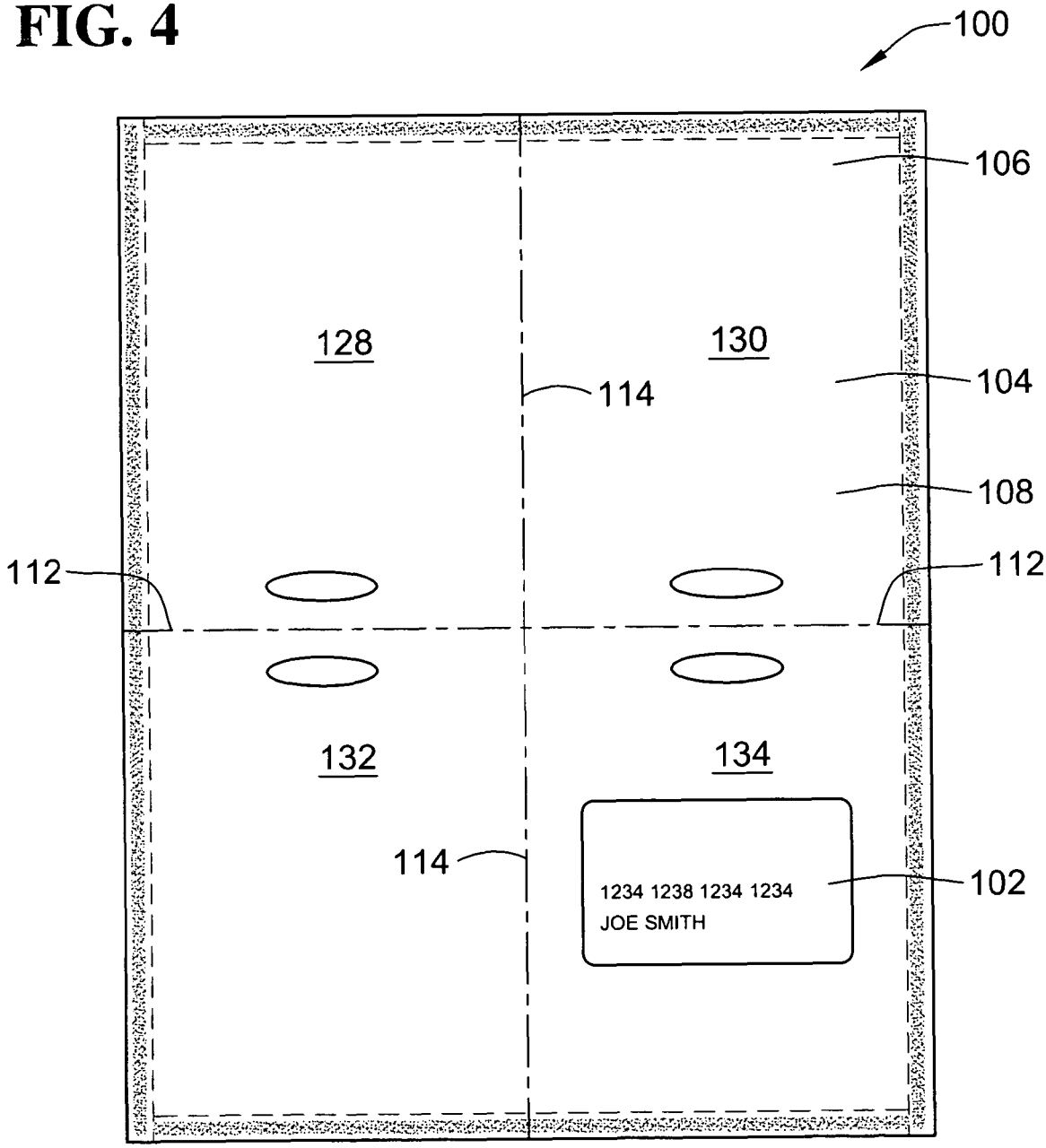
FIGS. 4, 5 and 6, respectively, sequentially illustrate the manner in which the intermediate sheet, of FIGS. 2 and 3, is sequentially folded and sealed to form the exemplary embodiment of the card package illustrated in FIG. 1.
Figure 5:
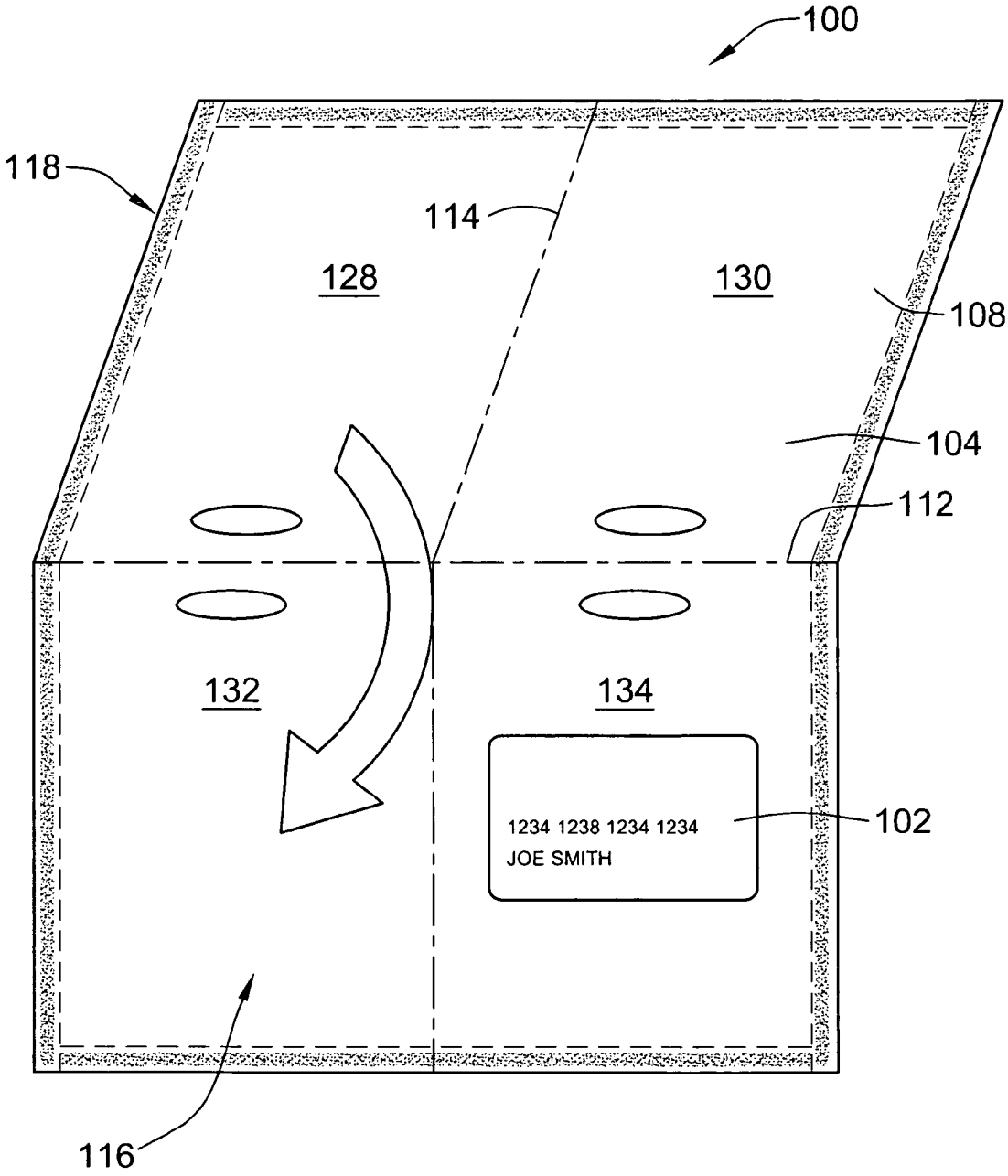
Figure 6:
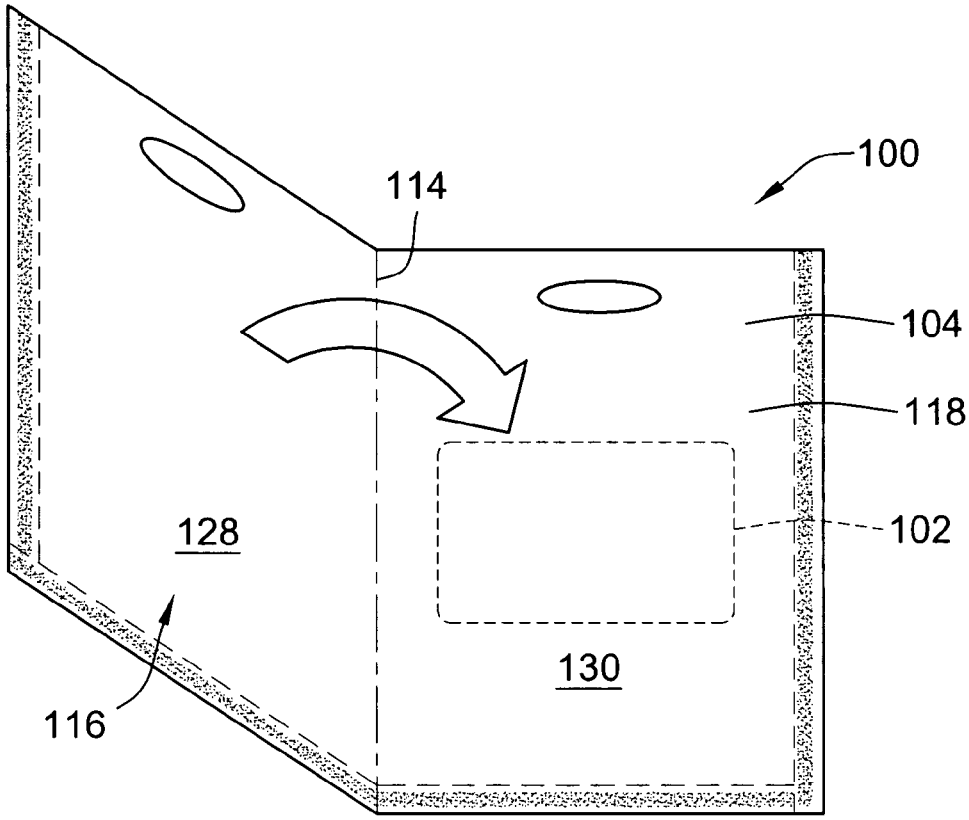

As shown in FIGS. 4-6, the intermediate sheet 106 of the exemplary embodiment of the point of sale package 104 is V-folded a first time, as shown in FIG. 5, about a first fold line 112, with the first face 108 of the intermediate sheet 106 disposed inside of the first V-fold formed about the first fold line 112, to form the resultant construction illustrated in FIG. 6. The resultant once V-folded intermediate sheet 106, in the form illustrated in FIG. 6, is then V-folded a second time about a second fold line 114 extending orthogonally to the first fold line 112, in the manner illustrated by the arrow in FIG. 6, to form a completely folded card package, substantially as illustrated in FIG. 1.

Figure 6A:
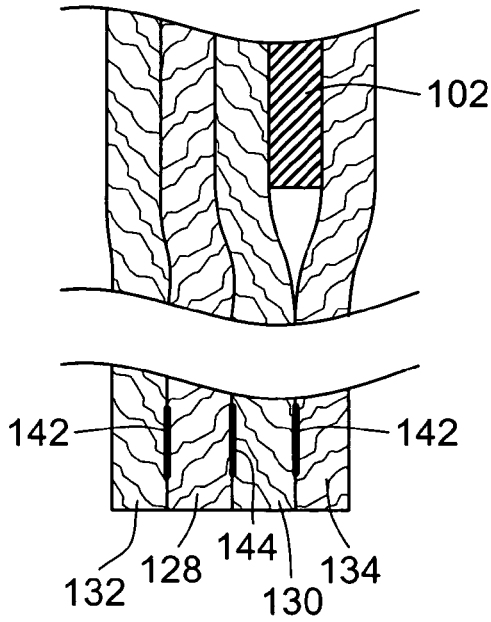
FIG. 6A is a partial, foreshortened, cross-sectional view, taken along line 6A-6A in FIG. 1, illustrating the stacked nature and location of adhesive sealing patterns along an L-shaped segment of the outer periphery of the completed exemplary embodiment of the point of sale card package shown in FIG. 1.

As a result of this folding operation, the completed point of sale card package 100 is formed from four stacked panels 128, 130, 132, 134, defined and connected at the fold lines 112, 114, in a manner described in greater detail below, such that each of the four panels 128, 130, 132, 134 has at least one first or second face 108, 110 thereof juxtaposed with a first or second face 108, 110 of an adjacent panel of the four stacked panels 128, 130, 132, 134, in the manner generally illustrated in FIG. 6A. As further indicated in FIG. 6A, and described in greater detail herein below, in the completed exemplary embodiment of the point of sale card package 100, the card 102 is disposed between the juxtaposed surfaces of two adjacent ones of the stacked panels 128, 130, 132, 134 and is attached to one of the two juxtaposed faces of the adjacent stacked panels 128, 130, 132, 134.

As best seen in FIGS. 2 and 5, the first face 108 of the intermediate sheet 106 is adapted to form the majority of an interior 116 of the card package. The portion 118 of the second face 110 of the intermediate sheet 106, located above the first fold line 112, as illustrated in FIGS. 3, 5 and 6 is likewise adapted to form part of the interior 116 of the card package 104, following completion of both the first and second V-folds. The portion 120 of the second face 110, located below the first fold line 112, as shown in FIG. 3, forms the exterior 122 of the card package 104, as indicated in FIG. 1, when the card package 104 has been constructed.

As shown in FIGS. 2 and 3, the intermediate sheet 106 includes an outer periphery 124 thereof, centered and extending symmetrically about the intersection 126 of the first and second fold lines 112, 114 of the intermediate sheet 106, such that each of the first, second, third, and fourth panels 128, 130, 132, 134 of the intermediate sheet 106 includes a respective part of the first and second faces 108, 110 of the intermediate sheet 106. The first and second panels 128, 130 are joined to one another along the second fold line 114. The third and fourth panels 132, 134 are also joined to one another along the second fold line 114. The first and third panels 128, 132 are joined to one another along the first fold line 112. The second and fourth panels 130, 134 are also joined to one another along the first fold line 112.

A line of weakness, in the form of a pattern of perforations 136, is disposed adjacent the periphery 124 of the intermediate sheet 106, and extends substantially completely along the periphery 124, to thereby define a margin 138, extending along the periphery 124, between the perforations 136 and the periphery 124 of the intermediate sheet 106. Specifically, in the exemplary embodiment, as shown in FIG. 3, the pattern of perforations 136 substantially follows the rectangular-shaped periphery 124 of the intermediate sheet 106, with the exception that the pattern of perforations 136 includes four segments 140 thereof, along the long sides of the rectangle, extending substantially parallel to the second fold line 114 from the remainder of the pattern of perforations to the top and bottom edges of the intermediate sheet 106, as oriented in FIGS. 2 and 3.

As shown in FIG. 2, a first elongated pattern 142 of adhesive is disposed in the margin 138 on the first face 108 of the intermediate sheet 106, and extends substantially entirely around the rectangular portion of the pattern of perforations 136.

In similar fashion, as shown in FIG. 3, a second elongated pattern 144 of adhesive is disposed in the margin 138 on the second face 110 of the intermediate sheet 106, but extends substantially entirely only along the upper half, as shown in FIG. 3, of the rectangular portion of the pattern of perforations 136, along the first and second panels 128, 130.

In the exemplary embodiment 100, the first and second patterns of adhesive 142, 144 are illustrated as substantially continuous bands of adhesive, but in practicing the invention, the adhesive need not be a continuing band. The patterns 142, 144 of adhesive may be made up of a series of discontinuous adhesive segments.

As illustrated in FIGS. 2 and 3, in some embodiments of the invention it may be desirable to have the second elongated pattern 144 of adhesive disposed farther outward from the line of weakness 140, at a greater distance $D_2$, than the first elongated pattern 142, with the second elongated pattern disposed at a lesser distance $D_1$ from the line of weakness 140, so that an inner edge 145 of the second line of adhesive 144 is disposed outside of an outer edge 143 of the first pattern 142 of adhesive. This arrangement precludes having the adhesive 142, 144 in the margins of adjacent intermediate sheets stick to one another while the intermediate sheets are stacked prior to being V-folded, and thereby causing feed problems or jamming of the type experienced during the manufacture of prior card packages or other types of business forms.

As will be seen through comparison of FIGS. 2 and 3, the first elongated pattern 142 of adhesive is substantially rectangular shaped, in the exemplary embodiment 100, while the second elongated pattern 144 of adhesive, on the second face of the intermediate sheet 106 is substantially U-shaped. By virtue of this orientation of the first and second patterns 142, 144 of adhesive, it will be understood, by those having skill in the art, that when the intermediate sheet 106 is first V-folded about the first fold line, the portion of the first elongated pattern 142 of adhesive extending along the peripheries of the first and second panels 128, 130 is brought into juxtaposition with the portion of the first elongated pattern 142 of adhesive extending around the third and fourth panels 132, 134 of the intermediate sheet 106. In similar fashion, due to the U-shaped configuration of the second elongated pattern 144 of adhesive, when the second V-fold is made about the second fold line 114, the portion of the second elongated pattern 144 of adhesive extending around two sides of the first panel 128 are brought into juxtaposition with the remaining portion of the second elongated pattern 144 of adhesive, extending along two sides of the second panel 130.

In the exemplary embodiment of the point of sale package 104, the adhesive on both the first and second elongated patterns 142, 144 of adhesive is a pressure activated cohesive, such as the product sold under the trade name Fastbond® Pressure Sensitive Adhesive 4224NF by the 3M® Company of St. Paul, Minn. or another appropriate cohesive, so that once the first and second V-folds have been completed, the point of sale card package 104 may be sealed by applying pressure to the L-shaped portion 146 of the margins 138 of the stacked panels 128, 130, 132, 134, for sealing the point of sale package 104.

As illustrated in FIG. 2, the intermediate sheet 106, of the exemplary embodiment of the point of sale package 104, includes a hanging feature, in the form of a through hole 148, in each of the panels 128, 130, 132, 134, with the holes 148 being symmetrically disposed about the first and second fold lines 112, 114 in such a manner that the holes 148 and the individual panels 128, 130, 132, 134 will be substantially aligned with one another when the sheet is V-folded a first time about the first fold line 112, and then V-folded a second time about the second fold line 114. By virtue of this arrangement, the completed point of sale card package 100 may be displayed on a peg hook, or other hook of a display apparatus, passing through the aligned holes 148 in the point of sale package 104.

Figure 7:
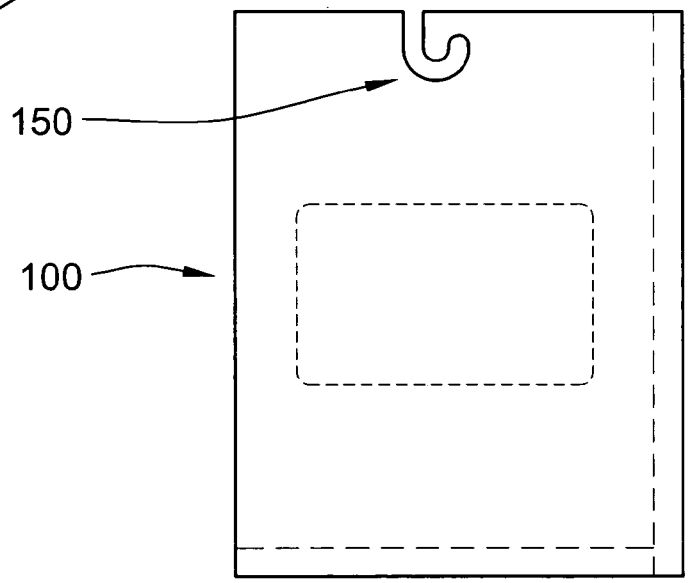
FIGS. 7 and 8 illustrate alternate embodiments of hanging features, according to the invention.
Figure 8:
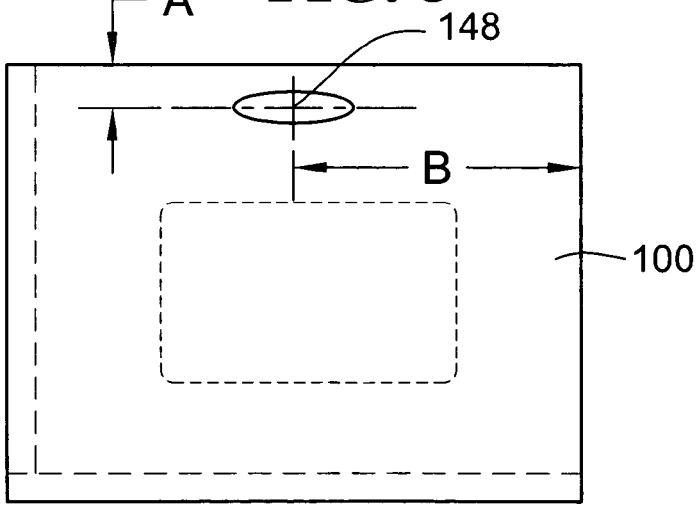

As will be understood, from a comparison of FIGS. 2 and 7, the relative distances A from the second fold line, and B from the first fold line 112, to the center of the respective holes 148 in the intermediate sheet 106 can be altered, in the manner illustrated in FIG. 7, so that the completed point of sale card package 100 hangs from a long edge thereof, as shown in FIG. 7, rather than a short edge thereof as shown in FIG. 1. Furthermore, those having skill in the art will recognize that the invention is not limited to the particular shape of a hanging feature, as illustrated in FIGS. 1-7, but can also be formed in other configurations, such as the outwardly opening notch shown in FIG. 8, or multiple notches, holes, etc. for use in holding the completed point of sale card package in a desired orientation on a peg hook, or other support device. It will be further understood, that the invention may also be practiced without the use of a hanging feature, according to the invention.

In an exemplary embodiment of a process for manufacturing the exemplary embodiment of the completed point of sale card package 100, the card 102 is attached to the first face of the fourth panel 134 with an appropriate adhesive, or with double-sided tape, for example, in the manner illustrated in FIG. 2, while the intermediate sheet 106 is still basically in a flat condition. In some embodiments of the invention, it may be desirable to pre-score the intermediate sheet 106 along one or both of the first and second fold lines 112, 114, to facilitate formation of the first and second V-folds. Once the card 102 is attached to the fourth panel 134, of the exemplary embodiment 100, the intermediate sheet 106 is twice folded, in the manner described hereinabove and illustrated in FIGS. 4-6, and then sealed along the L-shaped portion 146 of the margin 138 to complete construction of the point of sale card package 100.

In some embodiments of the invention, the first and/or second faces of the intermediate sheet 106 may be pre-printed with text and/or graphics prior to attachment of the card 102. In some forms of the invention, the intermediate sheet 106 may alternatively, or additionally, be dynamically printed with text and/or graphics substantially contemporaneously with attachment of the card 102 to the first face 108 of the intermediate sheet 106. The dynamically printed text and/or graphics may be uniquely linked to information on, or encoded into, the card 102, in some embodiments of the invention. For example, the text and/or graphics printed onto the intermediate sheet 106, may include personalized information, such as the name and address, of a particular vendor of the completed point of sale card package. As another example, activation instructions, unique to the particular card 102, such as a phone number to be called for activation of the card 102, may be linked to a particular card number, or information magnetically encoded into the card 102, or through an RFID or product bar code imprinted onto the card.

Figure 10:
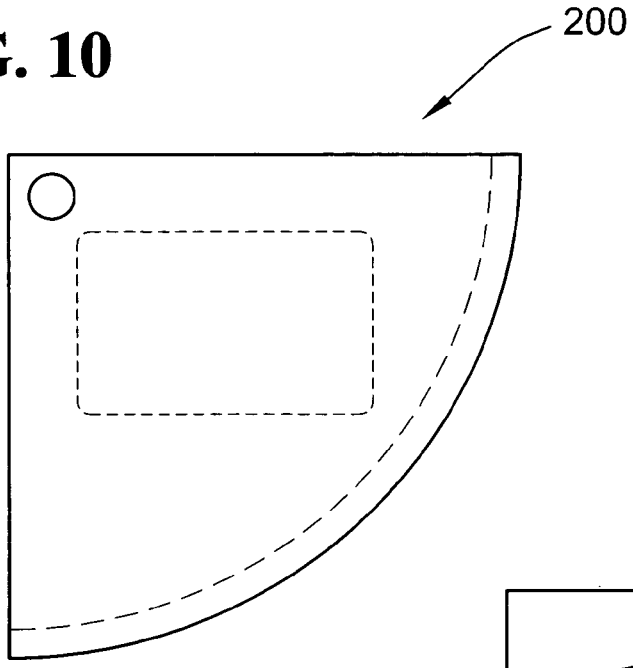
FIGS. 9 and 10 illustrate an alternate embodiment of a completed point of sale card package, according to the invention, having a circular peripheral profile, prior to folding, and a pie shape, following completion of the alternate embodiment of the point of sale card package.
Figure 9:
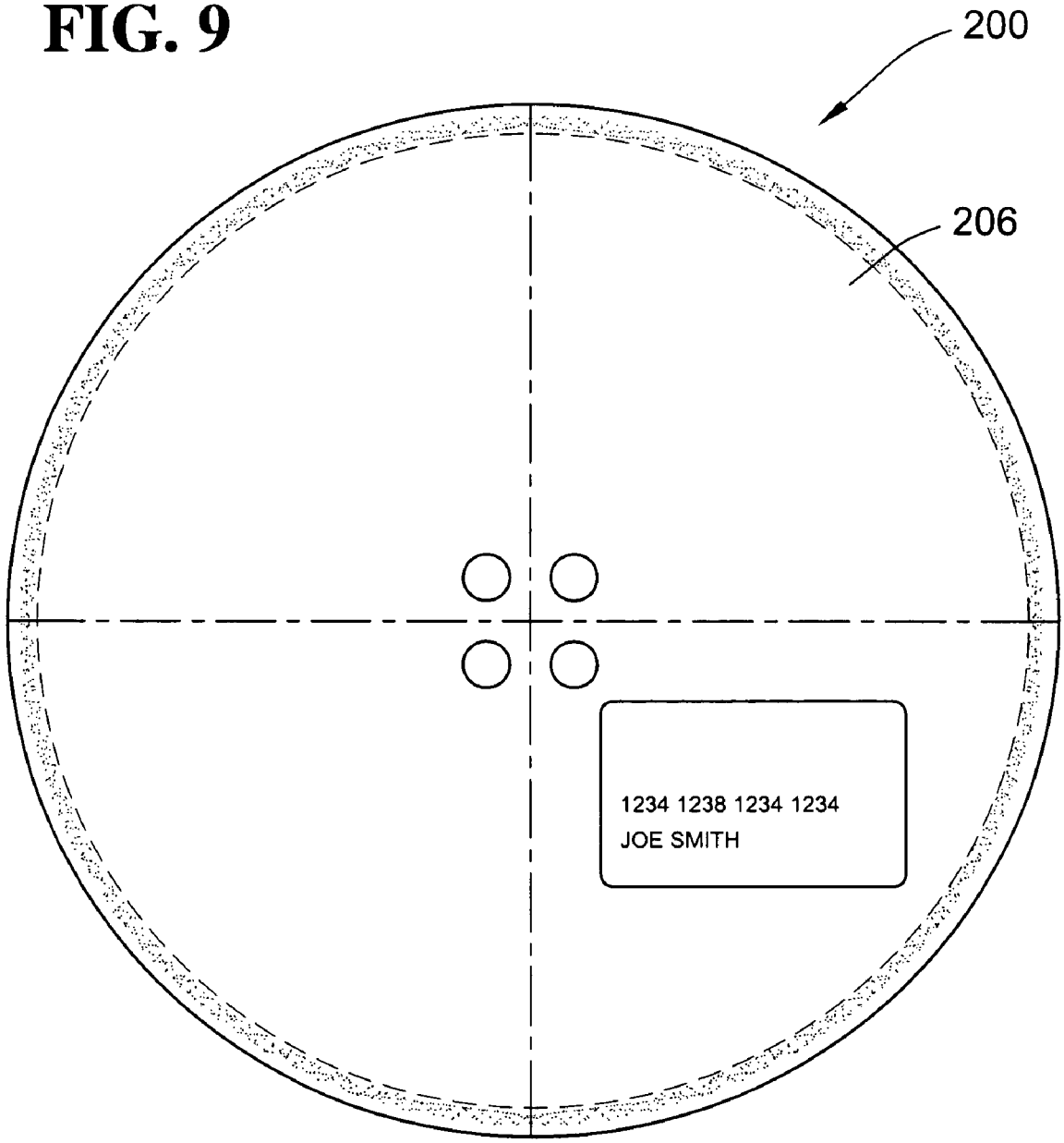

It will be understood, by those having skill in the art, that although the invention has been described and illustrated herein using representative exemplary embodiments, the invention may be practiced in a wide variety of other forms. For example, although the intermediate sheet 106 of the exemplary embodiment was a rectangular-shaped, substantially letter-sized piece of paper material, in other embodiments of the invention, the intermediate sheet and the point of sale package may take other forms. For example, as shown in FIGS. 9 and 10 and alternate embodiment of an intermediate sheet 206 of a second exemplary embodiment of a point of sale card package 200 may have a non-rectangular periphery, such as a square, a diamond, or a fully or partially rounded periphery, for example, an intermediate 206 having a circular periphery as shown in FIG. 9, such that the resulting completed point of sale card package 200 has a pie-shape, as shown in FIG. 10. It will also be noted, that although the card 102 in the first exemplary embodiment 100, of the invention described hereinabove, was attached to the first face 108 of the fourth panel 134, the card 102 could also have been attached to the first face of any of the first through fourth panels 128, 130, 132, 134, or to the second face of either the first or second panels 128, 130 and still be completely enclosed within the completed point of sale card package 100. It will be further noted that the point of sale card package 100 may include multiple cards, or other inserts attached to the various faces of the completed card package, or enclosed within the completed card package.

In some embodiments of the invention, it may be desirable to attached cards, or other elements to the exterior surfaces of the completed point of sale card package, in addition to, or in place of having the cards located inside. It is further noted, that a point of sale card package, according to the invention, may also include openings therethrough, or transparent portions thereof, for viewing the front and/or back side of a card, insert, or other item attached to or disposed within the interior of the point of sale card package, in accordance with the invention. For maximum security, however, it will generally be preferred that the card be fully enclosed within the interior of the card package, so that tampering is essentially precluded, so long as the seal along the edge of the card package remains unbroken and the remainder of the card package remains in tact.

Those having skill in the art will recognize that the card package of the present invention provides considerable enhancements in security, as compared to prior point of sale card packages. Damage to the sealed card package, or attempts to open the seal to gain access to the card are readily visually apparent to a seller or perspective buyer or user of a card enclosed within a point of sale card package, according to the invention.

It will be noted, by those having skill in the art, that the invention provides an improved point of sale card package, which is compatible with high speed manufacturing, utilizing commonly available paper material sizes, such as an 8½"×11' letter size, for example, on standard equipment in the industry such as a Datacard® 9000S Series Card Issuance System. In one embodiment of a method, according to the invention, for using such a card issuance system, an intermediate sheet 106 having the pressure sensitive adhesive applied thereto, in accordance with the invention, and including any holes or other hanging elements may be inserted into the machine along with the cards, for encoding of the cards, any related dynamic printing onto the intermediate sheet, attachment of the card to the intermediate sheet, and formation of the first V-fold and the intermediate sheet. The once-folded intermediate sheet 106, with the card attached thereto may then be moved to a second folding station, or another automated folding machine for formation of the second V-fold, and application of pressure to the pressure sensitive cohesive, through a pressure roller, for example, to seal and complete construction of the point of sale card package. In various embodiments of the invention, such commonly available machinery may be utilized for performing any and all of the steps of a method, according to the invention, described herein, or any additional steps within the scope of the invention.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventor for carrying out the invention. Variations of those preferred embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. The combination of a point of sale package and a credit-card-like card attached to the point of sale package, the combination comprising:

a sheet of paper material having a first face adapted to form the majority of an interior of the card package, and a second face adapted to form part of the interior of the card package and part of an exterior of the card package when the card package is constructed;

the sheet having an outer periphery thereof centered and extending symmetrically about an intersection of first and second orthogonally intersecting fold lines of the sheet, to define first, second, third and fourth panels of the sheet, with each panel including a respective part of the first and second faces of the sheet;

the first and second panels being joined to one another along the second fold line, the third and fourth panels being joined to one another along the second fold line, the first and third panels being joined to one another along the first fold line, and the second and fourth panels being joined to one another along the first fold line;

a line of weakness disposed adjacent the periphery of the sheet and extending substantially completely around the periphery, to thereby define a margin extending about the periphery between the line of weakness and the periphery;

a first elongated pattern of adhesive disposed in the margin on the first face of the sheet and extending substantially entirely around the line of weakness; and a second elongated pattern of adhesive disposed in the margin on the second face of the sheet and extending substantially entirely along a portion of the line of weakness in the first and second panels only;

wherein, the front face of one of the panels is adapted for having the credit-card-like card attached thereto in such a manner that the card is disposed completely within the front face of the one of the panels and further disposed completely between the juxtaposed faces of the one of the panels and an adjacent one of the panels when the intermediate is folded first about the first fold line and then about the second fold line to form a folded intermediate of four stacked panels, and further such that the card is completely enclosed within the folded intermediate when the patterns of adhesive are adhering to a faying surface of a juxtaposed face of one of the four stacked panels.

2. The combination of claim 1, wherein, the adhesive in one or both of the first and second elongated patterns of adhesive is a pressure activated cohesive.

3. The combination of claim 1, wherein, the sheet is adapted:

to be first V-folded about the first fold line, to place the first face of the first panel into juxtaposition with the first face of the third panel and the first face of the second panel into juxtaposition with the first face of the fourth panel; and to then be V-folded a second time about the second fold line, to place the second face of the first panel into juxtaposition with the second face of the second panel.

4. The combination of claim 1, wherein, each of the panels further defines a hanging feature extending therethrough, with the hanging features of the panels being symmetrically disposed about the intersection of the first and second fold lines in such a manner that the hanging features of the panels will be substantially aligned with one another when the sheet is V-folded a first time about the first fold line, and then V-folded a second time about the second fold line.

5. The combination of claim 1, wherein:

the adhesive in one or both of the first and second elongated patterns of adhesive is a pressure activated cohesive;

the sheet is adapted to be first V-folded about the first fold line, to place the first face of the first panel into juxtaposition with the first face of the third panel and the first face of the second panel into juxtaposition with the first face of the fourth panel; and the sheet is further adapted to then be V-folded a second time about the second fold line, to place the second face of the first panel into juxtaposition with the second face of the second panel.

6. The combination of claim 5, wherein, each of the panels further defines a hanging feature extending therethrough, with the hanging features of the panels being symmetrically disposed about the intersection of the first and second fold lines in such a manner that the hanging features of the panels will be substantially aligned with one another when the sheet is V-folded a first time about the first fold line, and then V-folded a second time about the second fold line.

7. The combination of claim 5, wherein, the sheet is substantially rectangular in shape, having first and second opposite parallel longitudinally extending sides, and opposite parallel transverse ends, the first fold line extending parallel to the longitudinally extending sides and being disposed centrally therebetween, and the second fold line extending parallel to the transversely extending ends and being disposed centrally therebetween.

8. The combination of claim 1, further comprising, a second insert disposed between the juxtaposed surfaces of two other adjacent ones of the stacked panels and attached to one of the two juxtaposed surfaces of the two other adjacent stacked panels.

9. The combination of claim 1, wherein, each of the panels of the sheet of the intermediate further defines a hanging feature extending therethrough, with the hanging features of the panels being symmetrically disposed about the intersection of the first and second fold lines in such a manner that the hanging features of the panels will be substantially aligned with one another when the sheet is V-folded a first time about the first fold line, and then V-folded a second time about the second fold line.

10. The combination of claim 1, wherein, the adhesive bonds juxtaposed surfaces of the stacked panels to one another.

11. The combination of claim 10, wherein, the adhesive in one or both of the first and second elongated patterns of adhesive is a pressure activated cohesive.

12. The combination claim 11, wherein, the second elongated pattern of adhesive is disposed farther outward from the line of weakness than the first elongated pattern of adhesive.

13. The intermediate of claim 1, wherein, the second elongated pattern of adhesive is disposed farther outward from the line of weakness than the first elongated pattern of adhesive.

14. The intermediate of claim 13, wherein, the adhesive in one or both of the first and second elongated patterns of adhesive is a pressure activated cohesive.

15. A method for manufacturing a point of sale card package for a credit-card-like-card, the method comprising:

manufacturing an intermediate including a sheet of paper material having a first face adapted to form the majority of an interior of the card package, and a second face adapted to form part of the interior of the card package and part of an exterior of the card package when the card package is constructed;

the sheet having an outer periphery thereof centered and extending symmetrically about an intersection of first and second orthogonally intersecting fold lines of the sheet, to define first, second, third and fourth panels of the sheet, with each panel including a respective part of the first and second faces of the sheet;

the first and second panels being joined to one another along the second fold line, the third and fourth panels being joined to one another along the second fold line, the first and third panels being joined to one another along the first fold line, and the second and fourth panels being joined to one another along the first fold line;

forming a line of weakness disposed adjacent the periphery of the sheet and extending substantially completely around the periphery, to thereby define a margin extending about the periphery between the line of weakness and the periphery;

applying a first elongated pattern of adhesive disposed in the margin on the first face of the sheet and extending substantially entirely around the line of weakness;

applying a second elongated pattern of adhesive disposed in the margin on the second face of the sheet and extending substantially entirely along a portion of the line of weakness in the first and second panels only;

adapting the front face of one of the panels for having a credit-card-like card attached thereto in such a manner that the card is disposed completely within the front face of the one of the panels and further disposed completely between the juxtaposed faces of the one of the panels and an adjacent one of the panels when the intermediate is folded first about the first fold line and then about the second fold line to form a folded intermediate of four stacked panels, and further such that the card is completely enclosed within the folded intermediate when the patterns of adhesive are adhering to a faying surface of a juxtaposed face of one of the four stacked panels; and attaching the card to the first face of one of the panels.

16. The method of claim 15, further comprising, printing text and/or graphics onto a portion of at least one of the first and second faces of the sheet substantially contemporaneously with attaching the card to the first face of the one of the panels.

17. The method of claim 16, wherein, the text and/or graphics printed onto the sheet are uniquely linked to information on, or encoded into, the card.

18. The method of claim 17, further comprising, prior to attaching the card, pre-printing text and/or graphics onto a portion of at least one of the first and second faces of the sheet.

19. The method of claim 15, further comprising:

V-folding the sheet a first time about the first fold line with the first face of the sheet disposed inside the V-fold; and V-folding the resultant V-folded sheet a second time about the second fold line, to place the panels in a stacked orientation with respect to one another, in such a manner that each panel has at least one first or second face thereof juxtaposed with a first or second face of an adjacent panel of the stacked panels.

20. The method of claim 19, wherein the adhesive in one or both of the first and second elongated patterns of adhesive is a pressure activated cohesive, and the method further comprises, applying pressure to the margins of the stacked panels for sealing the package.

* * * * *

UNITED STATES PATENT AND TRADEMARK OFFICE

CERTIFICATE OF CORRECTION

PATENT NO. : 7,941,948 B2
APPLICATION NO. : 11/503229
DATED : May 17, 2011
INVENTOR(S) : Doug Bardolph et al.

It is certified that error appears in the above-identified patent and that said Letters Patent is hereby corrected as shown below:

On the Title page, item 57, line 7 (abstract), "and the with separate" should read --and with separate--.

In the Claims

Claim 12, col. 11, line 37, "combination claim 11" should read --combination of claim 11--.

Signed and Sealed this
Twenty-second Day of April, 2014

Michelle K. Lee

Michelle K. Lee
*Deputy Director of the United States Patent and Trademark Office*